US005352863A

United States Patent [19]

Svendsen

[11] Patent Number: 5,352,863

[45] Date of Patent: Oct. 4, 1994

[54] FLAT BED THERMOPHOTOGRAPHIC FILM PROCESSOR

[75] Inventor: John Svendsen, Marine on the St. Croix, Minn.

[73] Assignee: Minnesota Mining and Manufacturing Company, St. Paul, Minn.

[21] Appl. No.: 862,830

[22] Filed: Apr. 3, 1992

[51] Int. Cl.[5] ..... H05B 1/00

[52] U.S. Cl. ..... 219/388; 219/216; 198/780; 193/37; 492/59

[58] Field of Search ..... 219/216, 388; 34/41, 34/18; 101/424.1; 392/417; 198/780, 952; 193/37; 432/246, 236; 492/46, 48, 59

[56] References Cited

U.S. PATENT DOCUMENTS

| | | | |
|---|---|---|---|
| 1,378,721 | 5/1921 | Rohdiek | 219/388 |
| 1,724,645 | 8/1929 | De Long | 101/424.1 |
| 2,157,388 | 5/1939 | MacArthur | 101/424.1 |
| 2,761,365 | 9/1956 | Bridgewater | 219/216 |
| 3,359,404 | 12/1967 | Limberger | 219/216 |
| 3,471,682 | 10/1969 | Hisey | 219/388 |
| 3,629,549 | 12/1971 | Svendsen . | |
| 3,648,019 | 3/1972 | Brewitz . | |
| 3,687,541 | 8/1972 | Aser | 219/216 |
| 3,709,472 | 1/1973 | Kreitz et al. . | |
| 3,746,448 | 7/1973 | Kitch | 219/216 |
| 3,774,520 | 11/1973 | Smith et al. . | |
| 3,810,735 | 5/1974 | Moser | 219/216 |
| 3,933,514 | 1/1976 | Banks et al. | 106/75 |
| 4,161,644 | 7/1979 | Yanagawa | 219/216 |
| 4,182,611 | 1/1980 | Knaak | 432/246 |
| 4,275,959 | 6/1981 | Jones | 219/388 |
| 4,360,259 | 11/1982 | Burgess | 354/299 |
| 4,389,562 | 6/1983 | Chaudoir | 219/388 |
| 4,397,451 | 8/1983 | Kinoshita | 219/388 |
| 4,518,845 | 5/1985 | Svendsen . | |
| 4,780,729 | 10/1988 | Murakami et al. | 346/76 PH |
| 4,915,025 | 4/1990 | Miyazaki | 101/424.1 |
| 4,939,992 | 7/1990 | Bird | 101/424.1 |
| 5,046,264 | 9/1991 | Hultzsch et al. | 34/41 |

FOREIGN PATENT DOCUMENTS

| | | | |
|---|---|---|---|
| 0476694A2 | 3/1992 | European Pat. Off. . | |
| 816380 | 8/1937 | France | 492/56 |
| 1147599 | 3/1985 | U.S.S.R. | 101/424.1 |
| 2176264 | 12/1986 | United Kingdom | 193/37 |
| 2186279 | 8/1987 | United Kingdom | 198/780 |

OTHER PUBLICATIONS

1500 Dry Diazo Duplicator Brochure, by 3M Office Systems Division.

*Primary Examiner*—Bruce A. Reynolds
*Assistant Examiner*—John A. Jeffery
*Attorney, Agent, or Firm*—Gary L. Griswold; Walter N. Kirn; David L. Weinstein

[57] ABSTRACT

A developer for sheets of dry silver media includes an oven having a film entrance and a film exit. A bed of spaced rollers of low thermal conductivity foam material is positioned within the oven between the entrance and exit. A roller drive mechanism rotates the rollers causing the film to be transported through the oven and developed without visible patterns.

38 Claims, 1 Drawing Sheet

FLAT BED THERMOPHOTOGRAPHIC FILM PROCESSOR

BACKGROUND OF THE INVENTION

The present invention is a method and apparatus for developing sheets of thermophotographic or heat developable film.

Thermophotographic film typically includes a thin polymer or paper base coated with an emulsion of dry silver or other heat sensitive material. Once the film has been imaged, it is developed through the application of heat. Devices and methods for developing thermophotographic film are generally known and disclosed, for example, in the following U.S. Pat. Nos.:

| Inventor | U.S. Pat. No. |
|---|---|
| Svendsen | 3,629,549 |
| Brewitz | 3,648,019 |
| Kreitz et al. | 3,709,472 |
| Svendsen | 4,518,845 |

The Svendsen U.S. Pat. Nos. 3,629,549 and 4,518,845 both disclose developers having thermally insulating drums concentrically mounted within a heating member. Sheets of film to be developed are engaged by the drum and driven around the heating member. Unfortunately, developers of this type are relatively complicated and poorly suited for use with film having soft emulsions. Since the side of the film bearing the emulsion will contact either the insulating drum or the heating member, the film is subject to damage by sticking or scratching.

The development device disclosed in the Kreitz et al. U.S. Pat. No. 3,709,472 uses a heated drum to develop strips of film, and is not suitable for single sheets of film having soft emulsion layers.

The Brewitz U.S. Pat. No. 3,648,019 discloses a developer with a pair of heaters on opposite sides of a low thermal mass locating device such as a screen assembly. Although it is portable, this developer is relatively slow and poorly suited for commercial applications.

Other thermophotographic film developers include a heated drum which is electrostatically charged to hold the film thereon during development. Since the side of the film bearing the emulsion is not in contact with the drum or other developer components, it is not subject to sticking or scratching as in some of the developers discussed above. Unfortunately, the electrostatic system used to hold the film on the drum during development is relatively complicated and poorly suited for developers configured to develop larger sized sheets of film.

The 3M Model 261 and 262 thermal diazo processor system uses a belt to transport the film as it is being heated. The belt is a relatively hard, polytetrafluoroethylene (PTFE) coated fiberglass member.

The 3M Model 1500 thermal diazo processor develops rolls of film by transporting the film over a hot drum, in a manner similar to that disclosed in the Kreitz et al. patent discussed above.

In general, and as is discussed in the background sections of the patents referenced above, the density of the developed image is dependant upon the amount of heat to which the film emulsion is exposed. Nonuniform heating ("hot spots") can produce an uneven developed image density. Uneven physical contact between the film and any supporting structures during the development process can also produce visible marks and patterns on the image.

It is evident that there is a continuing need for improved thermophotographic film developers. In particular, there is a need for a developer capable of quickly and uniformly developing large sheets of film without damaging the emulsion. To be commercially viable, any such developer must be capable of being efficiently manufactured.

SUMMARY OF THE INVENTION

The present invention is a developer capable of quickly and uniformly developing large sheets of thermophotographic film. The developer includes an oven having a film entrance and exit, a generally flat and horizontally oriented bed of film support material mounted for movement within the oven along a film transport path between the film entrance and exit, and a drive mechanism for driving the bed of material to transport the film through the oven along the path. The film support material has a sufficiently low heat capacity to enable visible pattern-free development of the film as the film is transported through the oven.

In one embodiment, the bed of film support material includes a plurality of spaced rollers of the material. The rollers are rotatably mounted within the oven along the film transport path, and include cylindrical tubes of the film support material surrounding support rods. Low density and low thermal conductivity foam is used as the film support material. The oven includes heat sources positioned above and below the rollers. The rollers are rotated at about the same speed to transport the film through the oven.

DETAILED DESCRIPTION OF THE PREFERRED EMBODIMENTS

Figure 1:
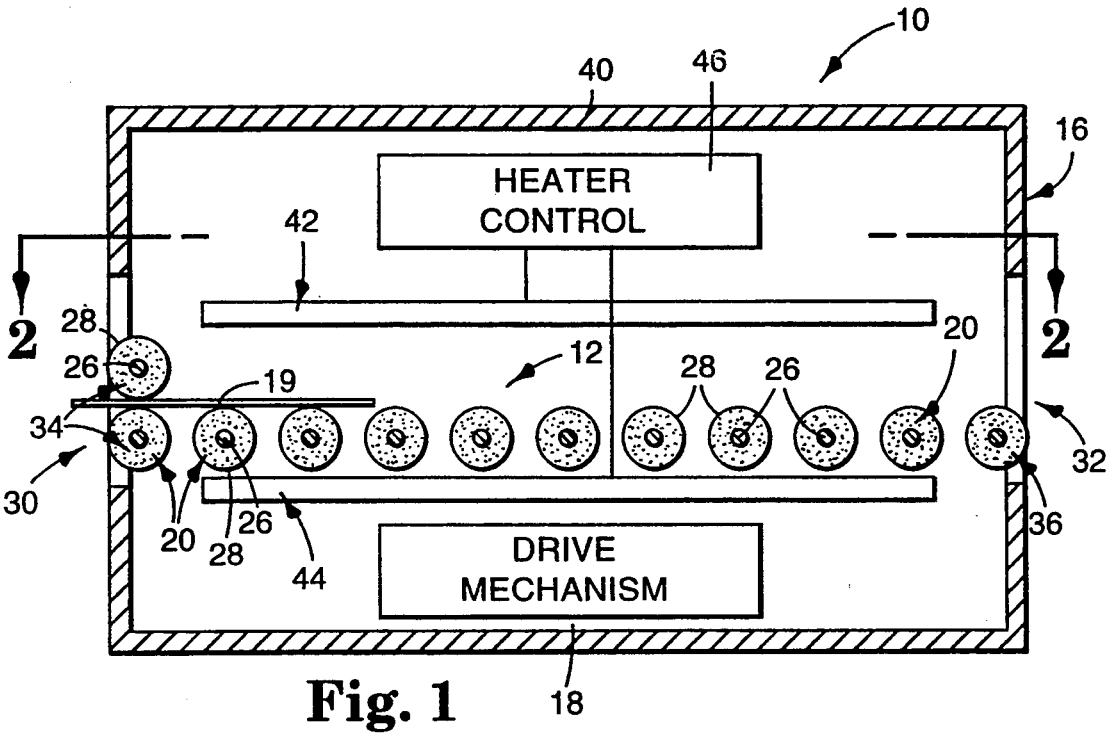
FIG. 1 is a diagrammatic side view of the interior of a developer in accordance with the present invention.
Figure 2:
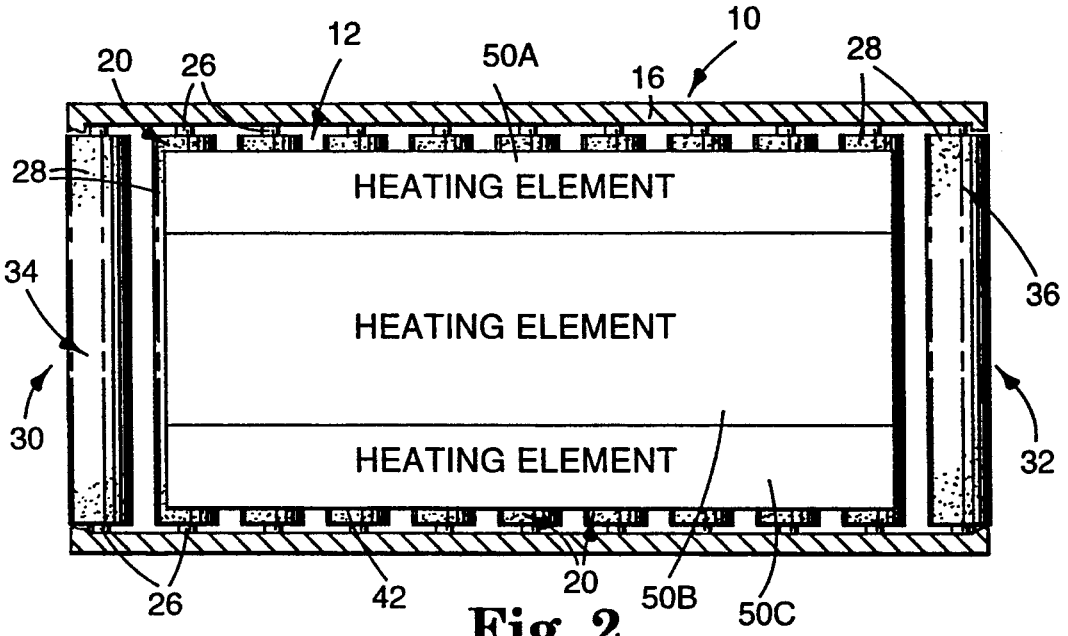
FIG. 2 is a diagrammatic top view of the interior of the developer taken along line 2—2 in FIG. 1.

A dry silver thermophotographic film processor 10 in accordance with the present invention is illustrated generally in FIGS. 1 and 2. Film processor 10 includes a generally flat and horizontally oriented bed 12 of film support material 28 mounted within an oven 16, and a drive mechanism 18 for driving the bed of film support material. As discussed in greater detail below, film support material 28 is a low heat capacity, and typically foam, material which retains insubstantial amounts of heat with respect to that generated by the oven and needed to develop the film. Transporting sheets of film such as 19 through oven 16 on this low heat capacity material 28 allows the film to develop without visible patterns that might otherwise be caused by differentials in the amount of heat (i.e., "hot spots") to which portions of the film are exposed due to varying physical contact with the transport material. The image on the developed film will therefore have a uniform intensity.

In the embodiment shown, bed 12 is formed by a plurality of elongated rollers 20 (ten are shown). Rollers 20 include support rods 26 with cylindrical sleeves of the film support material 28 surrounding the external surface of the rods. Rods 26 are rotatably mounted to the opposite sides of oven 16 to orient rollers 20 in a spaced, generally parallel relationship about a linear transport path between an entrance 30 and exit 32 of the oven. The generally flat and horizontally orientated nature of bed 12 enables frictional engagement of the bed by sheets of film 19. Oven entrance 30 is a nip formed between a pair of adjacent entrance rollers 34. Entrance and exit rollers 34 and 36 can be identical in structure to rollers 20, and include rods 26 surrounded by sleeves of film support material 28. Rollers 20, 34 and 36 are driven, preferably at the same speed, by drive mechanism 18. In one embodiment (not shown), drive mechanism 18 includes a motor coupled to all rods 26 by a gear linkage.

Oven 16 includes an enclosure 40 with heat sources 42 and 44 mounted above and below bed 12 of rollers 20. The temperature within oven 16 is controlled by heater control 46 which is coupled to both heat sources 42 and 44. As shown in FIG. 2, heat source 42 is a multiple zone source with plural (three are shown) heating elements 50A–50C. Heater control 46 includes a separate controller, such as a RTD controller (not shown), to independently control each heating element 50A–50C. Heat source 44 can be configured and controlled in a manner substantially identical to that of heat source 42. By independently controlling a number of heating elements such as 50A–50C, the temperature within oven 16 can be accurately controlled and maintained.

As noted above, film support material 28 has a sufficiently low heat capacity to prevent any visible patterns on the developed film due to contact with the bed 12. Materials 28 having these characteristics will typically be low density, low thermal mass and low thermal conductivity foam materials. Materials 28 of this type will retain sufficiently low amounts of residual heat that any such heat will not contribute to the development of the film 19. In one embodiment of processor 10, Willtec melamine foam having a density of 0.75 pounds per cubic foot (12.0 kg/m$^3$) and a thermal conductivity (K) of 0.24 is used for support material 28. Thermal conductivity (K) is preferably below about 3, more preferably below about 1, most preferably below about 0.25. Material 28 of this type is commercially available from Illbruck Corp. of Minneapolis, Minn. U.S.A. However, many other types of materials having these characteristics, including silicon polyimide foam, can also be used. Furthermore, it is anticipated that materials having even greater heat capacity, density and thermal conductivity than that specified above (e.g., up to 6 pounds per cubic foot (95 kg/m$^3$)) will prevent the development of visible patterns. Density is preferably below about 95 kg/m$^3$, more preferably below about 48 kg/m$^3$, most preferably below about 40 kg/m$^3$.

In one embodiment, the sleeves of film support material 28 are about 1 inch (2.54 cm) in diameter, and fabricated by coring and grinding a block of stock to a thickness of about 0.25 inch (0.63 cm). The sleeves of material 28 are then mounted to steel rods 26. These rollers 20 are mounted at about 2 inch (5 cm) centers.

Sheets of film 19 can be developed by feeding them into entrance 30 with the emulsion side down, facing rollers 20. This film orientation prevents the film from curling and contacting heat source 42 during development. The dwell time of film 19 within oven 16 (i.e., the speed at which rollers 20 are driven and/or the length of the transport path) and the temperature within the oven are optimized in a known manner to properly develop the film. In one embodiment, processor 10 is operated in such a manner as to expose sheets of film 19 to a temperature in the range of 245° F. to 300° F. (118° to 149° C.) for about 60 seconds. These parameters will, of course, vary with the particular characteristics of the film 19 being developed. Although not shown, a cooling chamber can be positioned adjacent exit 32 of processor 10 to quickly lower the temperature of the developed film 19 for subsequent handling.

Processor 10 offers considerable advantages over those of the prior art. It is a relatively simple and cost effective design, and can be configured to handle large format sheets of film. The processor also facilitates the high quality, (visible) pattern-free development of the film.

Although the present invention has been described with reference to preferred embodiments, those skilled in the art will recognize that changes may be made in form and detail without departing from the spirit and scope of the invention.

What is claimed is:

1. A developer for sheets of thermophotographic film, including:

an oven having a film entrance and a film exit:

a generally flat and horizontally oriented bed of film support material within the oven along a film transport path between the film entrance and film exit, for engaging and supporting the film; wherein the bed of film support material includes at least three spaced rollers, each of said rollers comprising a cylindrical tube comprising polymeric foam having low density and low thermal conductivity, said tube surrounding a support rod, said rollers rotatably mounted within the oven along the film transport path;

a drive mechanism for driving the bed of material to transport the film through the oven along the transport path, wherein the drive mechanism includes a roller drive mechanism for rotating the rollers and causing the rollers to transport the film through the oven along the transport path; and the film support material having a sufficiently low heat capacity to enable visible pattern-free development of the film as the film is transported through the oven.

2. The developer of claim 1 wherein said foam has a thermal conductivity less than about 3.

3. The developer of claim 1 wherein said foam has a thermal conductivity less than about 1.

4. The developer of claim 1 wherein said foam has a thermal conductivity less than about 0.25.

5. The developer of claim 1 wherein said foam has a density less than about 95 kg/m$^3$.

6. The developer of claim 1 wherein said foam has a density less than about 48 kg/m$^3$.

7. The developer of claim 1 wherein said foam has a density less than about 40 kg/m$^3$.

8. The developer of claim 1 wherein the oven includes heat sources above and below the rollers.

9. The developer of claim 8 wherein each of the heat sources includes a plurality of independently controlled temperature zones.

10. The developer of claim 1 wherein the oven includes a plurality of independently controlled temperature zones.

11. The developer of claim 1 wherein the rollers are positioned in a generally parallel orientation with respect to one another about a linear transport path.

12. The developer of claim 1 wherein the rollers are mounted about a generally horizontal transport path.

13. The developer of claim 1 wherein the roller drive mechanism includes a mechanism for rotating all the rollers at about the same speed.

14. A method for developing sheets of thermophotographic film having an emulsion on one side, including:

supporting the film in a hot oven on a generally flat and horizontally oriented bed of material including at least three rollers, each of said rollers comprising a cylindrical tube comprising polymeric foam having low density and a low thermal conductivity, said tube surrounding a support rod, said foam having a sufficiently low heat capacity to enable visible pattern-free development of the film; and driving the bed of material by rotating the rollers to transport the film through the oven as the film is being developed.

15. The method of claim 14 and further including uniformly heating the oven.

16. The method of claim 14 and further including rotating all the rollers at about the same speed.

17. The method of claim 14 wherein supporting the film includes supporting the film on the rollers with the emulsion toward the rollers.

18. The method of claim 14 wherein said foam has a thermal conductivity less than about 3.

19. The method of claim 14 wherein said foam has a thermal conductivity less than about 1.

20. The method of claim 14 wherein said foam has a thermal conductivity less than about 0.25.

21. A developer for sheets of thermophotographic film, including:

an oven having a film entrance and a film exit:

a generally flat and horizontally oriented bed of film support material within the oven along a film transport path between the film entrance and film exit, for engaging and supporting the film; wherein the bed of film support material includes at least three spaced rollers, each of said rollers comprising a cylindrical tube having low density and thermal conductivity below about 0.25, said tube surrounding a support rod, said rollers rotatably mounted within the oven along the film transport path;

a drive mechanism for driving the bed of material to transport the film through the oven along the transport path, wherein the drive mechanism includes a roller drive mechanism for rotating the rollers and causing the rollers to transport the film through the oven along the transport path; and the film support material having a sufficiently low heat capacity to enable visible pattern-free development of the film as the film is transported through the oven.

22. The developer of claim 21 wherein said tube has a density less than about 95 kg/m$^3$.

23. The developer of claim 21 wherein said tube has a density less than about 48 kg/m$^3$.

24. A method for developing sheets of thermophotographic film having an emulsion on one side, including:

supporting the film in a hot oven on a generally flat and horizontally oriented bed of material including at least three rollers, each of said rollers comprising a cylindrical tube having low density and thermal conductivity below about 0.25, said tube surrounding a support rod, said tube having a sufficiently low heat capacity to enable visible pattern-free development of the film; and driving the bed of material by rotating the rollers to transport the film through the oven as the film is being developed.

25. The method of claim 24 and further including uniformly heating the oven.

26. The method of claim 24 and further including rotating all the rollers at about the same speed.

27. The method of claim 24 wherein supporting the film includes supporting the film on the rollers with the emulsion toward the rollers.

28. A developer for sheets of thermophotographic film, including:

an oven having a film entrance and a film exit:

a generally flat and horizontally oriented bed of film support material within the oven along a film transport path between the film entrance and film exit, for engaging and supporting the film; wherein the bed of film support material includes at least three spaced rollers, each of said rollers comprising a cylindrical tube having a density below 48 kg/cm$^2$ and low thermal conductivity, said tube surrounding a support rod, said rollers rotatably mounted within the oven along the film transport path;

a drive mechanism for driving the bed of material to transport the film through the oven along the transport path, wherein the drive mechanism includes a roller drive mechanism for rotating the rollers and causing the rollers to transport the film through the oven along the transport path; and the film support material having a sufficiently low heat capacity to enable visible pattern-free development of the film as the film is transported through the oven.

29. The developer of claim 28 wherein said tube has a thermal conductivity less than about 3.

30. The developer of claim 28 wherein said tube has a thermal conductivity less than about 1.

31. The developer of claim 28 wherein said tube has a thermal conductivity less than about 0.25.

32. A method for developing sheets of thermophotographic film having an emulsion on one side, including:

supporting the film in a hot oven on a generally flat and horizontally oriented bed of material including at least three rollers, each of said rollers comprising a cylindrical tube having density below 48 kg/m$^3$ and low thermal conductivity, said tube surrounding a support rod, said tube having a sufficiently low heat capacity to enable visible pattern-free development of the film; and driving the bed of material by rotating the rollers to transport the film through the oven as the film is being developed.

33. The method of claim 32 and further including uniformly heating the oven.

34. The method of claim 32 and further including rotating all the rollers at about the same speed.

35. The method of claim 32 wherein supporting the film includes supporting the film on the rollers with the emulsion toward the rollers.

36. The method of claim 32 wherein said tube has a thermal conductivity less than about 3.

37. The method of claim 32 herein said tube has a thermal conductivity less than about 1.

38. The method of claim 32 wherein supporting the film includes said tube has a thermal conductivity less than about 0.25.

* * * * *